US005327123A

United States Patent [19]

Heimann et al.

[11] Patent Number: 5,327,123

[45] Date of Patent: Jul. 5, 1994

[54] TRAFFIC CONTROL SYSTEM FAILURE MONITORING

[75] Inventors: Kenneth R. Heimann, Corona; Hien T. Chu, Carson, both of Calif.

[73] Assignee: Traffic Sensor Corporation, Corona, Calif.

[21] Appl. No.: 872,770

[22] Filed: Apr. 23, 1992

[51] Int. Cl.[5] ..... G08G 1/07

[52] U.S. Cl. ..... 340/916; 340/912; 340/931; 340/641

[58] Field of Search ..... 340/916, 912, 931, 641, 340/642; 364/436

[56] References Cited

U.S. PATENT DOCUMENTS

| | | | |
|---|---|---|---|
| 2,166,721 | 7/1939 | Jeffers | 340/931 |
| 3,596,239 | 7/1971 | Hata | 340/931 |
| 3,629,802 | 12/1971 | Clark et al. | 340/931 |
| 3,648,233 | 3/1972 | Clark | 340/931 |
| 3,778,762 | 12/1973 | Jarko et al. | 340/931 |
| 3,902,156 | 8/1975 | Hill | 340/931 |
| 4,024,528 | 5/1977 | Boggs et al. | 340/310 A |
| 4,135,145 | 1/1979 | Eberle | 340/931 |
| 4,383,240 | 5/1983 | Staats, Jr. | 340/915 |
| 4,566,008 | 1/1986 | Powers et al. | 340/941 |

OTHER PUBLICATIONS

"Conflict Monitors", TS-1, Jan. 1983, Section 6, pp. 45–46, Nema Standard.

*Primary Examiner*—Donnie L. Crosland

*Attorney, Agent, or Firm*—William W. Haefliger

[57] ABSTRACT

A traffic control system for use at a roadway intersection, the system including traffic control lights, a light flasher structure, and a plurality of load switches electrically coupled with the lights via relay structure to which the flasher structure is connected, the load switches having inputs, and a controller connected with the load switches for controlling normal operation of the lights and flashing of one or more of the lights by the flasher structure in the event of a system malfunction comprising a microprocessor operatively connected with the load switches, flasher, and relay structure to monitor the system for detecting a malfunction event, for recording the detected malfunction event, and for transmitting the malfunction detection to another location; and verification structure at the other locations for i) receiving the transmitted malfunction detection, ii) verifying the event, and iii) initiating malfunction corrective action; whereby the corrective action in the system may be initiated without removing control by the controller of the operation of the traffic control lights at the intersection.

19 Claims, 13 Drawing Sheets

CPU
WATCH DOG
ATTENUATOR
MULTIPLEXER AMP
COMP
D to A
Vref
FLASHER
LOAD SWITCH
LOAD SWITCH
TRAFFIC CONTROLLER
R Y G
R Y G 41
96
45
95'
43
FLASHER
OPTO
190
LOGIC
17
LOAD SW. 1
18
LOAD SW. 2
19
LOAD SW. 3
97
98
99
110
110
110

TRAFFIC CONTROL SYSTEM FAILURE MONITORING

BACKGROUND OF THE INVENTION

This invention relates generally to traffic control systems, and more particularly to improvements in monitoring of traffic signal lights for proper operation at controlled roadway intersections.

The present art in the traffic control system uses a controller unit that energizes load switches that drive the signal lamps through a flash transfer relay. In the event that a conflicting signal should arise, a conflict monitor can actuate the relay to transfer the lamp loads to the flasher module.

The conflict monitor measures the traffic signal lamp voltages by converting the AC to DC, enabling a gate which then indicates whether the voltage is present or not. If two signal lamp voltages are ON at the same time in conflicting directions, for instance eastbound and northbound, traffic green signal lights ON, setting up a potential hazard; the conflict monitor will drop or de-energize the flash transfer relay, putting the lamp loads under the control of the flasher, thus putting the intersection into flash.

Prior art has defined a traffic control system as consisting of a traffic controller unit for the purpose of providing 24 volt DC input signals to one or more load switches used to turn traffic signal lamps ON. A conflict monitor device is used to monitor the presence of proper alternating current field wire voltages supplied to power the traffic signal lamps. When improper AC voltages exist, the conflict monitor causes an electromechanical relay to transfer, which in turn causes the high current capacity flash transfer relay to remove lamp power from the load switches and to connect the lamp power to a flasher unit, which causes the traffic signal lamps to flash ON and OFF.

In addition to monitoring the AC voltages on the outputs of load switches, the conflict monitor checks for the presence of a 24 volt DC output from the power supplies used by the traffic controller to produce 24 volt DC signals for turning the load switch outputs ON. The 24 volt DC signals supplied from the traffic controller to each of the individual load switch circuits have not previously been monitored within the conflict monitor or the controller unit. A proposed improvement to NEMA traffic control device standards, proposed standard TS2 for future design, would require communication between the traffic controller and the conflict monitor with information sent regarding the programmed traffic controller 24 volt DC signal status, but would not provide a measurement of the 24 volt DC signals actually present at the load switches. U.S. Pat. No. 4,383,240 describes monitoring of DC logic signals, storage, and display of same, along with output status conditions.

There is need for improvements in the control of signal flashing and in the detection and handling of system malfunctions, including that of signal lamps (bulbs), and for simplification of system apparatus and functions.

SUMMARY OF THE INVENTION

It is a major object of the invention to provide an improved system meeting the above needs.

The environment of the invention comprises a traffic control system for use at a roadway intersection, the system including traffic control lights, a light flasher means, and a plurality of load switches electrically coupled with the lights via relay means to which the flasher means is connected, the load switches having inputs, and a controller connected with the load switches for controlling normal operation of the lights and flashing of one or more of the lights by the flasher means in the event of a system malfunction.

In this environment, the invention provides:

a) a microprocessor operatively connected with the load switches and relay means to monitor the system for detecting a malfunction event, for recording the detected malfunction event, and for transmitting the malfunction detection to another location, b) and verification means at the other locations for i) receiving the transmitted malfunction detection, ii) verifying the event, and iii) initiating malfunction corrective action, c) whereby the corrective action in the system may be initiated without removing control by the controller of the operation of the traffic control lights at the intersection.

It is another object of the invention to provide means to monitor AC field wire voltages supplied via load switches to power the traffic control lights, and means to monitor DC inputs of the load switches to enable determination, for any load switch, which of three (red, yellow and green signals) DC inputs is ON.

As respects such DC monitoring, the invention provides:

a) a signal monitor means, b) each load switch having three DC inputs, three corresponding outputs, one output being turned ON in response to application of a DC ground to the corresponding DC input, c) a voltage summing circuit coupled to the input of each load switch, the circuit including three interconnected resistors respectively in series with the DC inputs, and the circuit coupled to the signal monitor means, d) the voltage summing circuit including three diodes respectively connected in series with the three resistors to prevent the DC inputs from feeding energy to the signal monitor means when the inputs are in off-state, e) the signal monitor means including an additional resistor coupled to a stable reference voltage, f) the additional resistor and the three resistors in the voltage summing circuit forming a voltage divider when a DC input to the load switch is selected by the controller, to allow determination of which DC input is ON, at a particular load switch.

As respects the reference to AC voltage monitoring, it is an object of the invention to provide conflict monitor means to sequentially compare the AC voltages with reference voltage in the monitor, the monitor also operating to provide DC signal monitoring, as referred to. Thus, the conflict monitor may comprise a module coupled to the input and output side of each load switch, to function as described.

It is another object to provide input monitor means with circuit means for transferring traffic signal lamp loads from the load switches to the flasher means under substantially no-load conditions whereby arcing at the flash transfer relay means is suppressed.

These and other objects and advantages of the invention, as well as the details of an illustrative embodiment, will be more fully understood from the following specification and drawings, in which:

DRAWING DESCRIPTION

Figure 1:
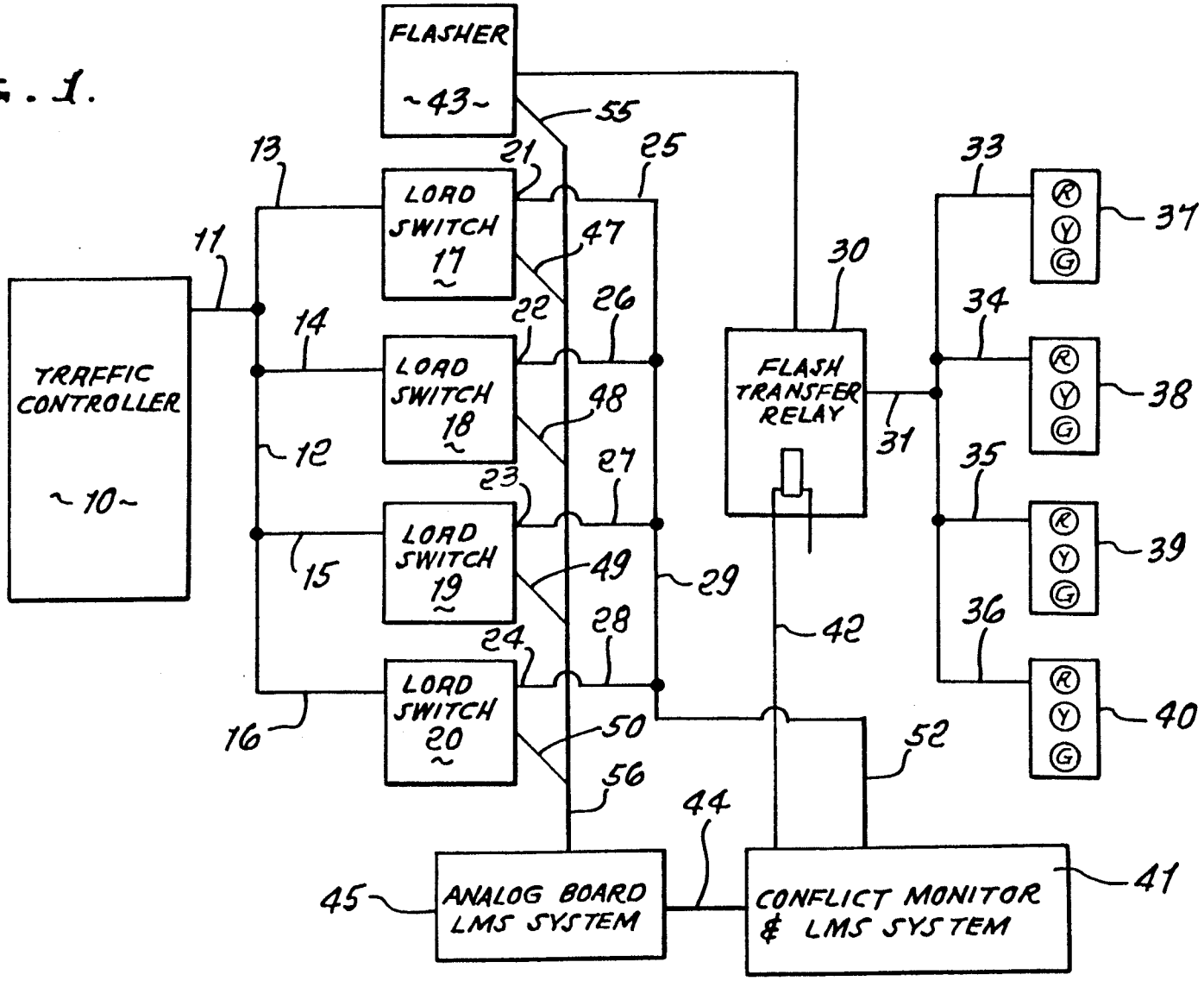
FIG. 1 is a system block diagram.
Figure 3:
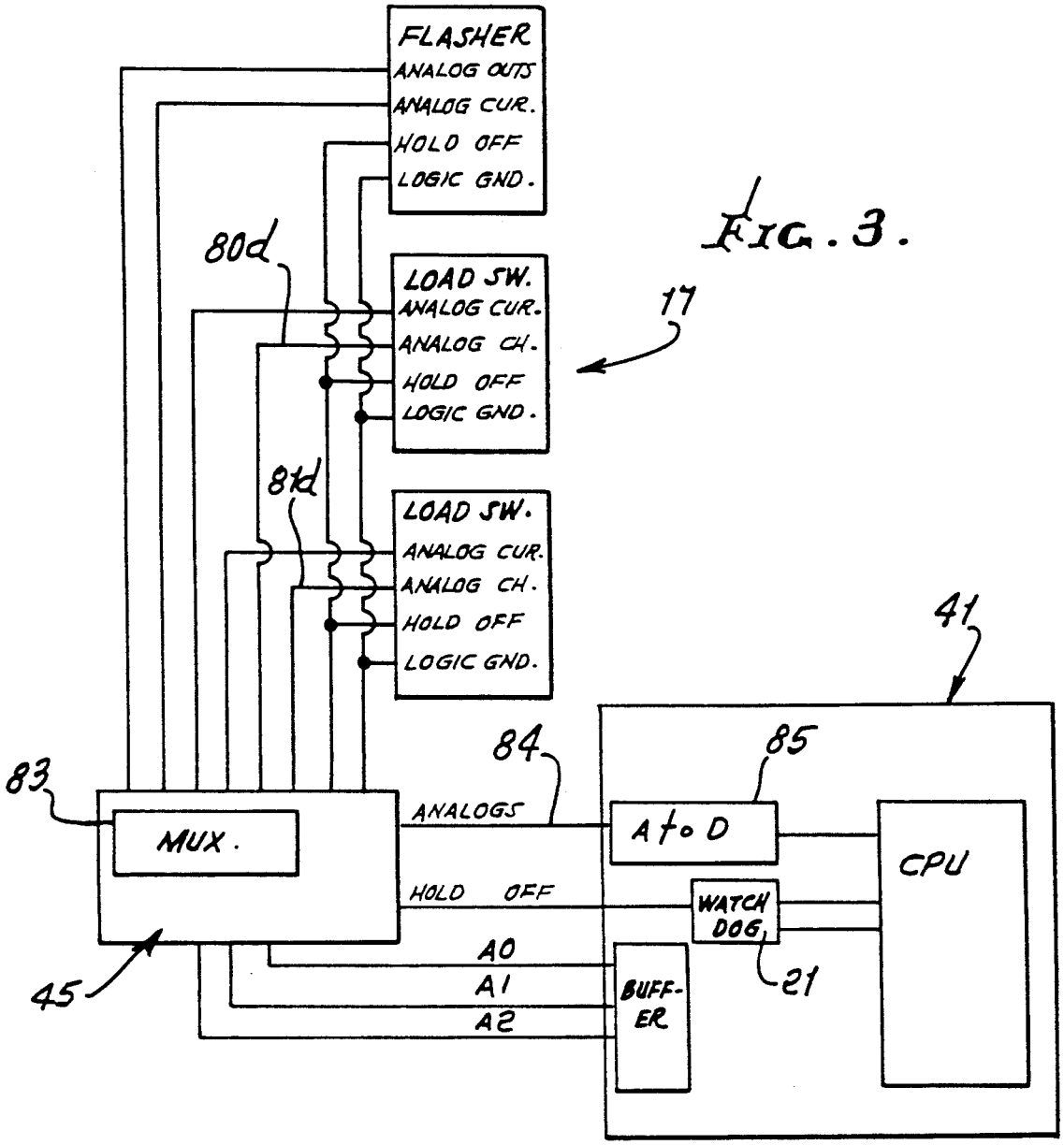
FIG. 3 is a block diagram showing monitoring of DC voltage input levels to load switches.
Figure 3A:
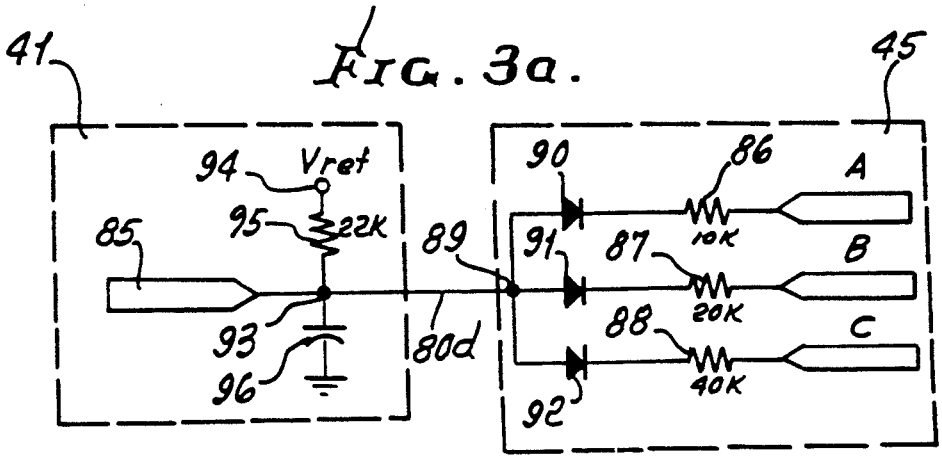
Figure 4:
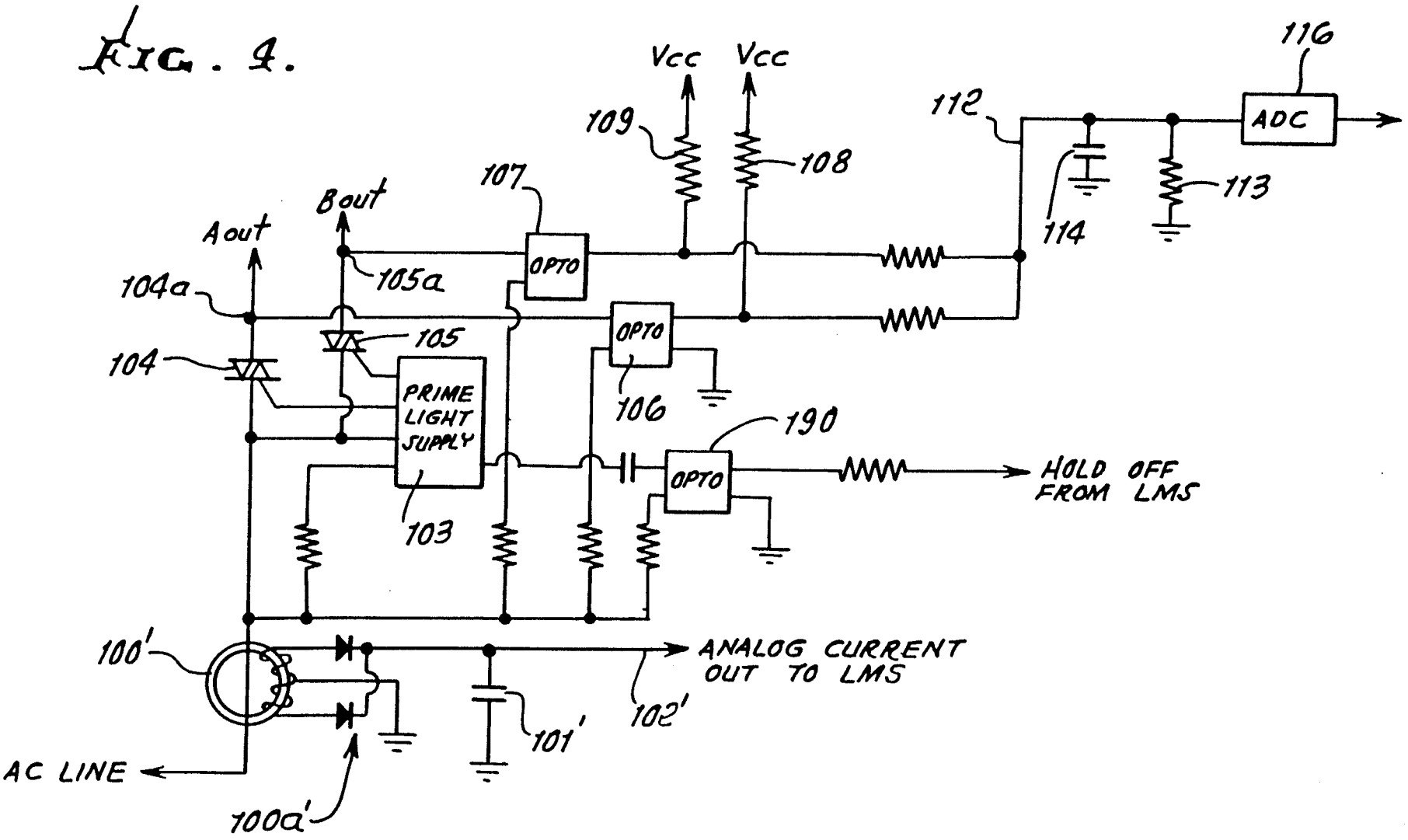
Figure 5:
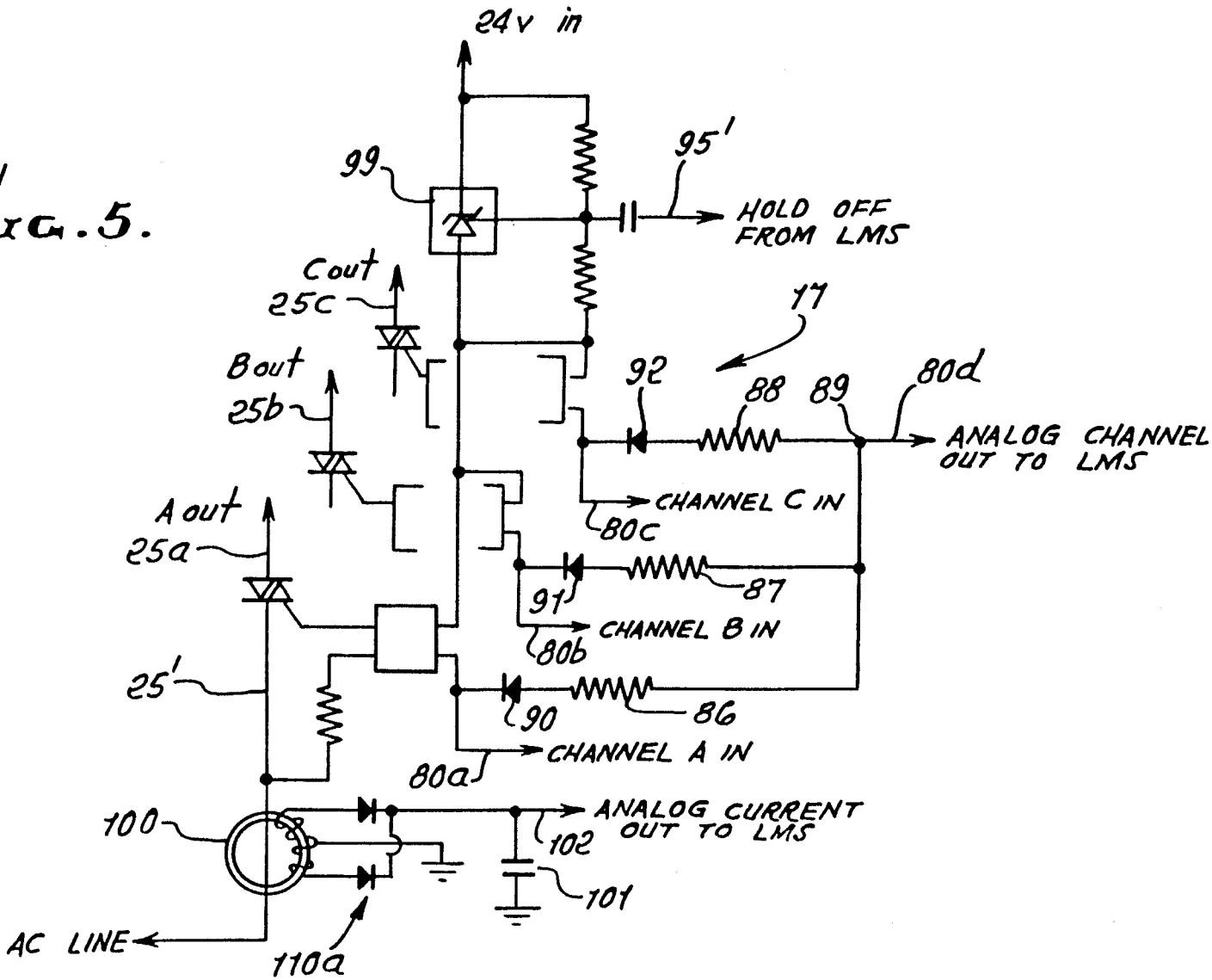
Figure 6:
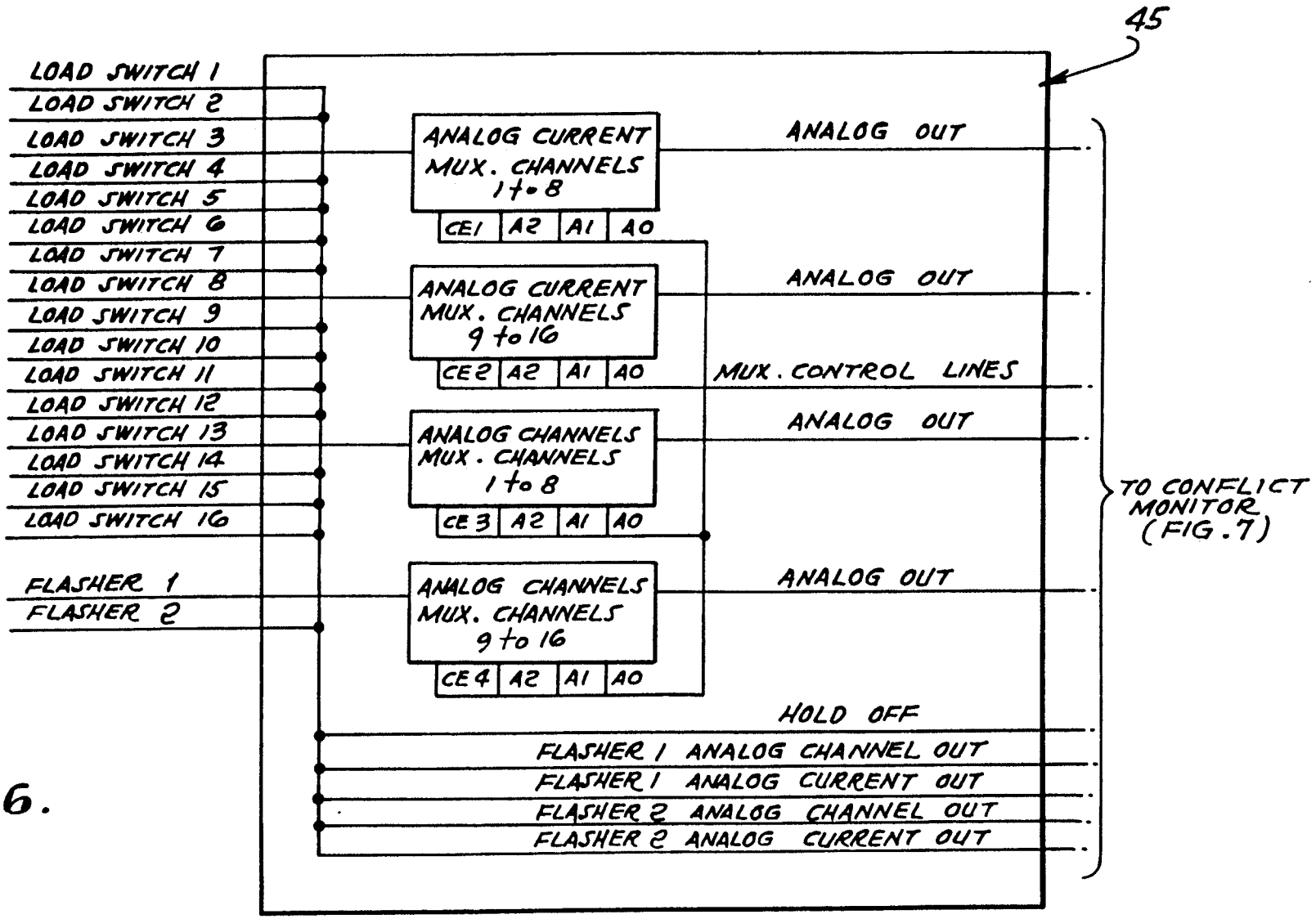
Figure 7:
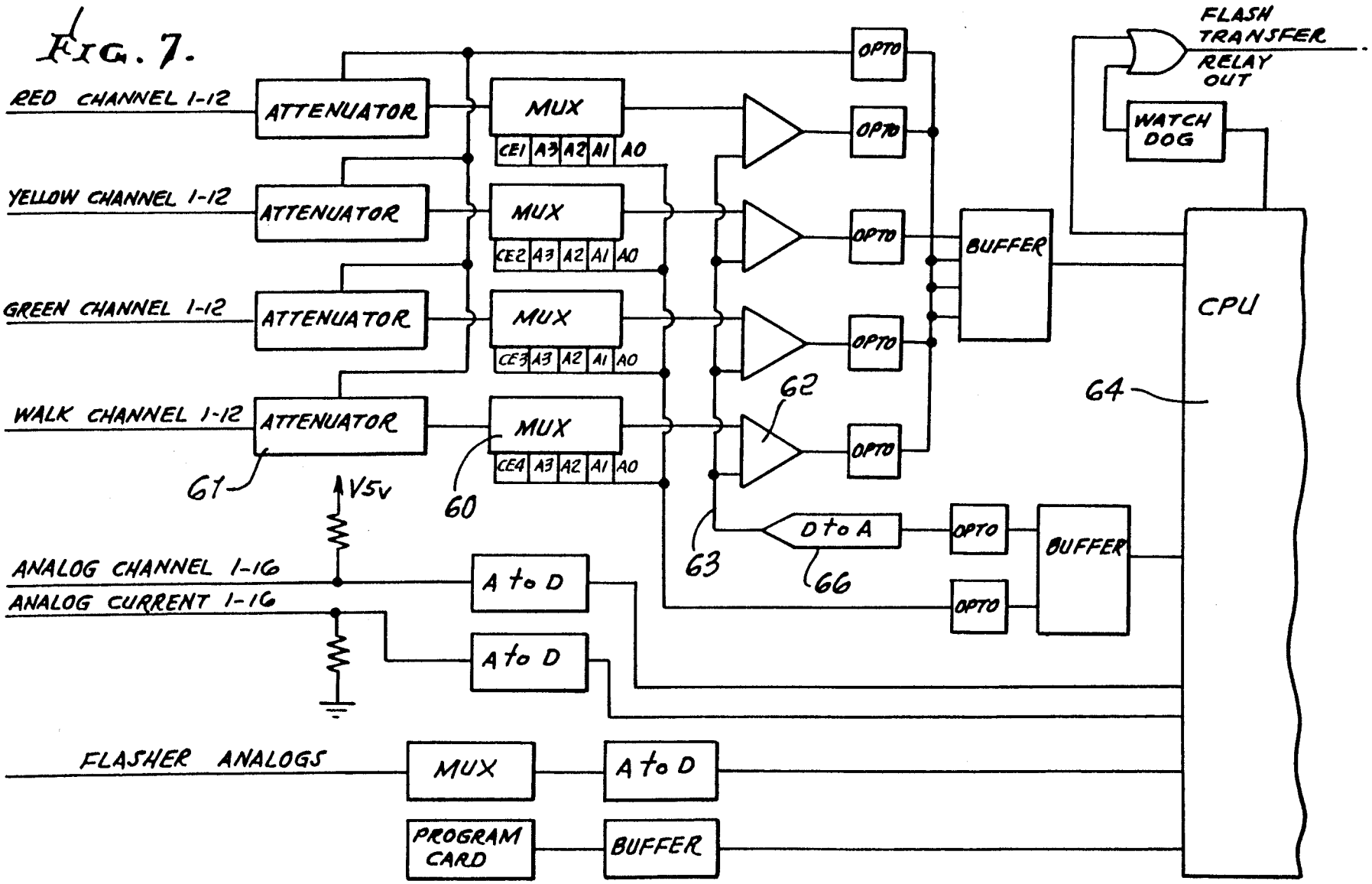
Figure 8:
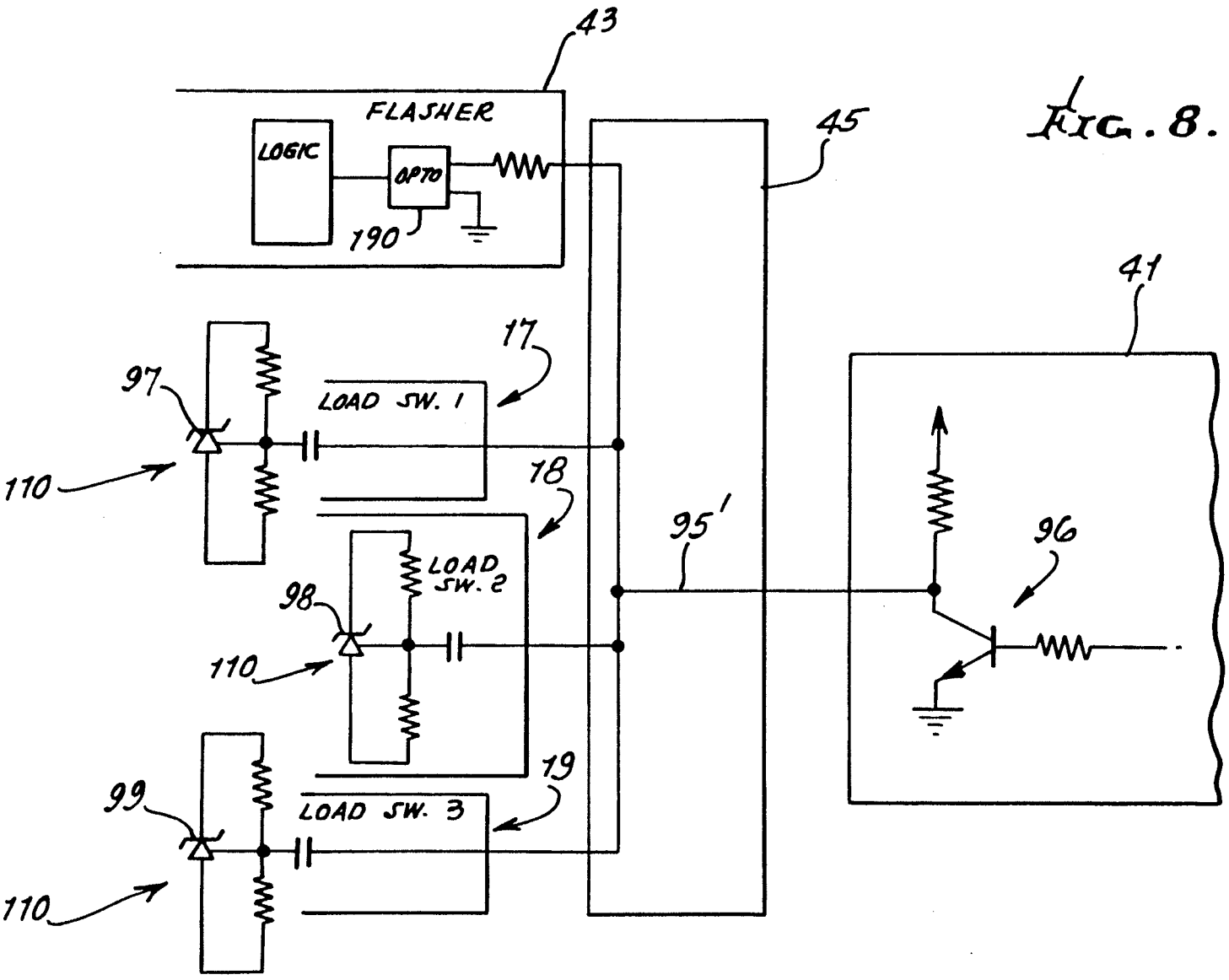
Figure 9:
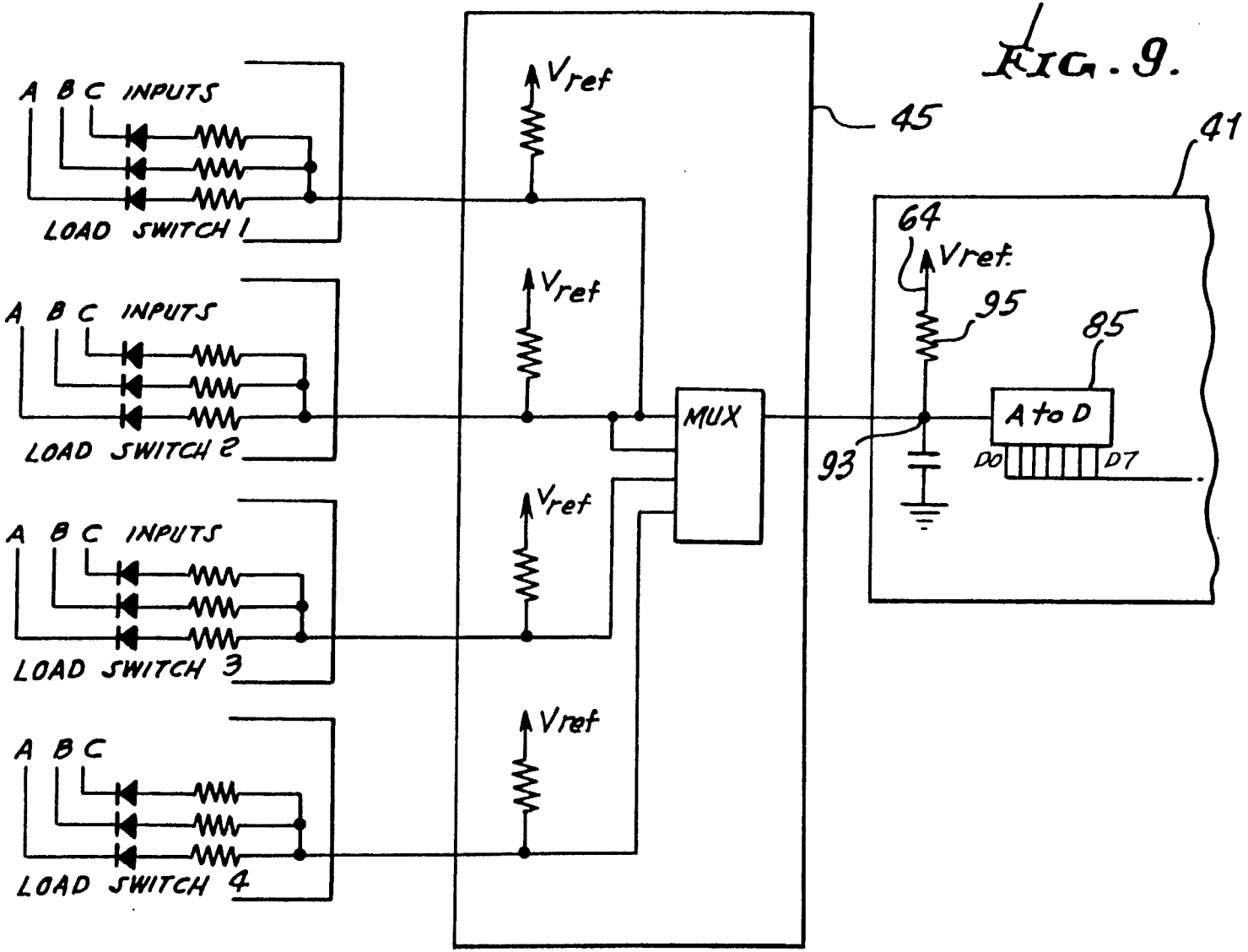
Figure 10:
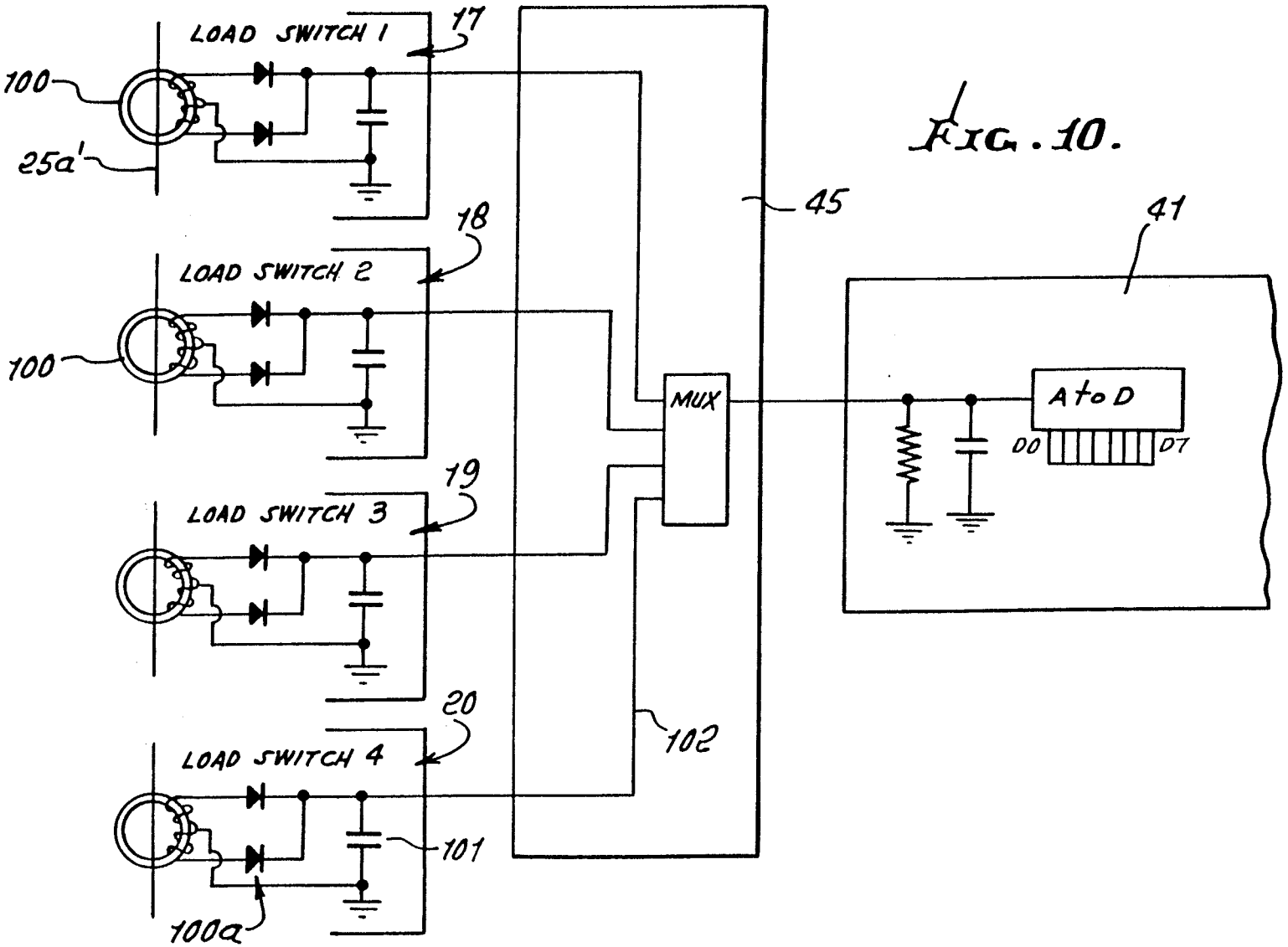
Figures 11A, 11B, 11C, 11D:
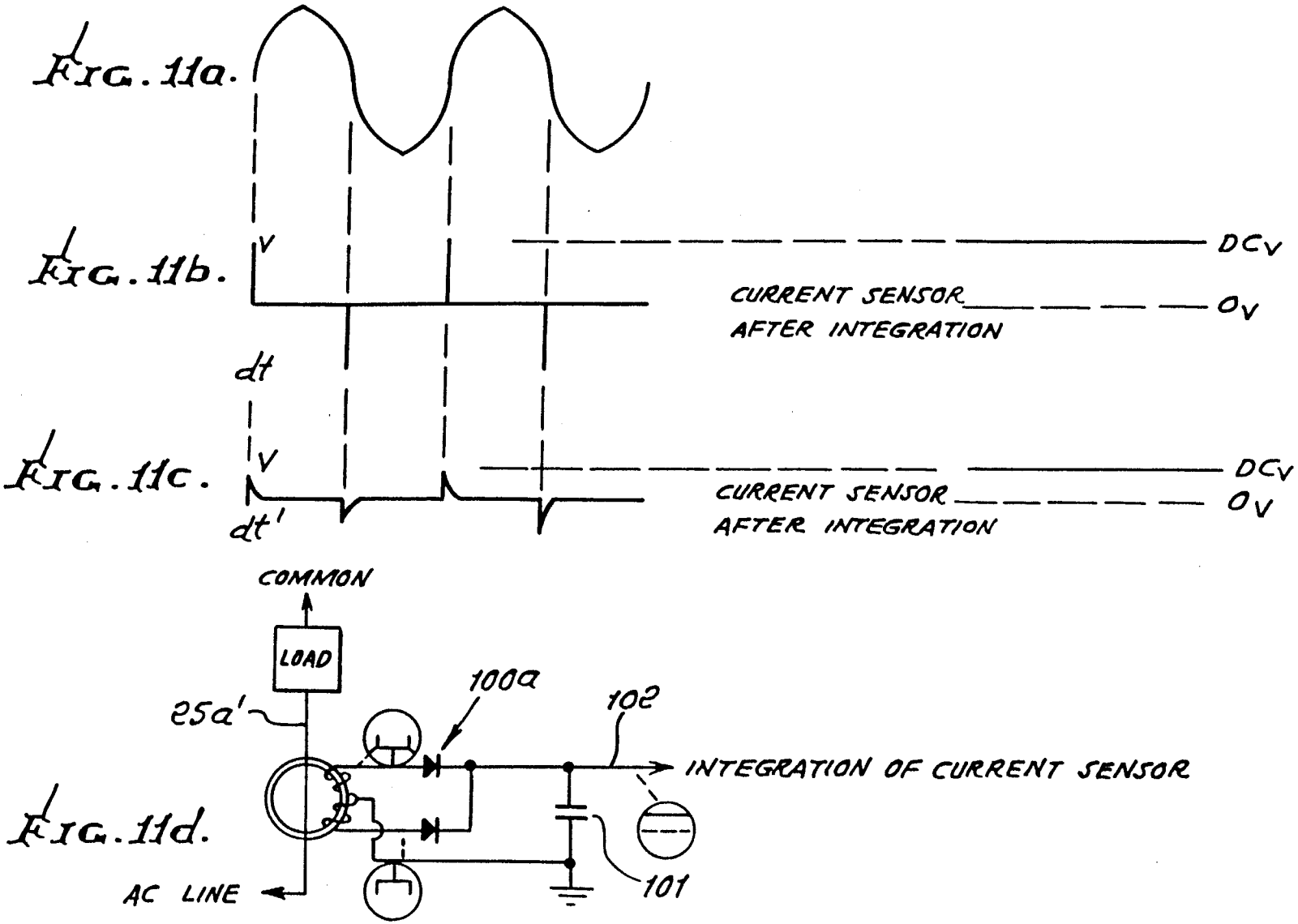
Figures 12A, 12B, 12C, 12D:
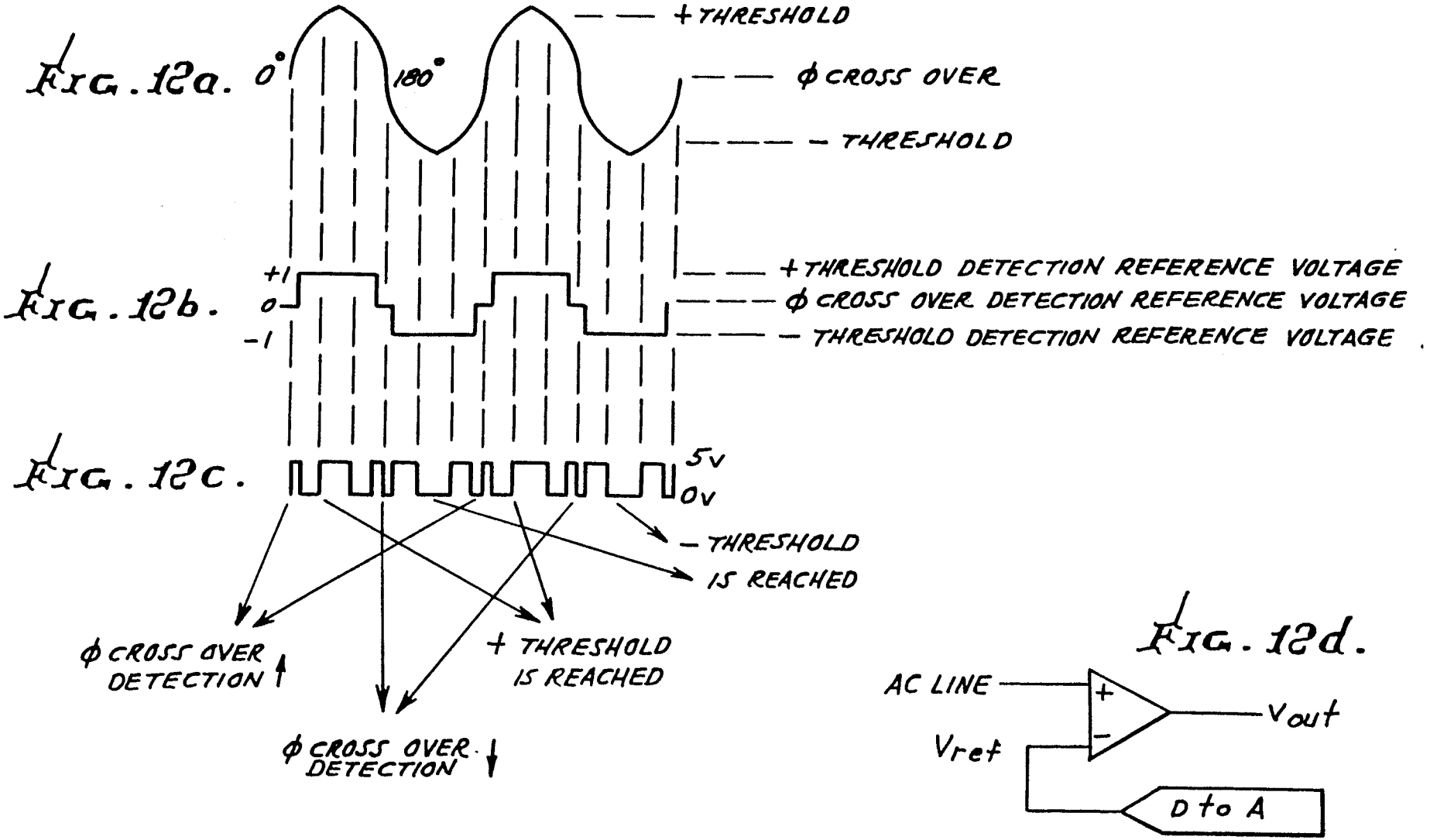
Figures 13A, 13B, 13C, 13D:
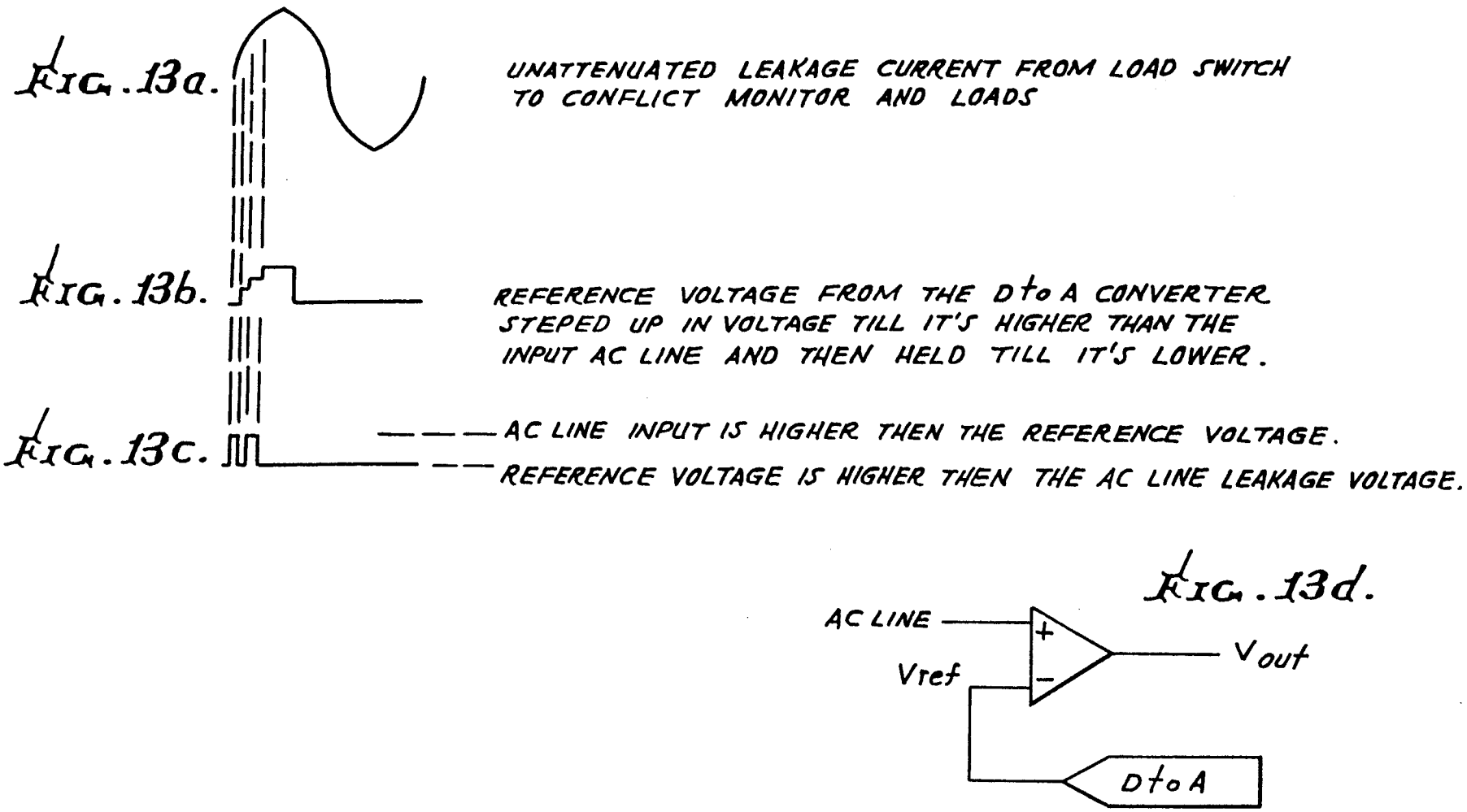

FIG. 3*a* is a circuit diagram;

FIG. 4 is a flasher circuit diagram;

FIG. 5 is a load switch circuit diagram;

FIG. 6 is an analog board circuit diagram;

FIG. 7 is a block diagram showing details of the conflict monitor seen in FIG. 1;

FIG. 8 is a "hold-off" circuit diagram;

FIG. 9 is a circuit diagram showing analog board coupling between load switch inputs and the conflict monitor;

FIG. 10 is a circuit diagram showing use of saturable care reactors in the load switches;

FIGS. 11(*a*), 11(*b*), and 11(*c*) are wave forms;

FIG. 11(*d*) is a circuit diagram showing integration of circuit sensor signals, as represented in FIG. 11 (*c*);

FIGS. 12(*a*), 12(*b*), and 12(*c*) are wave forms; and 12(*d*) is a comparator circuit; and FIGS. 13(*a*), 13(*b*),and 13(*c*) are wave form diagrams, and 13(*d*)is a comparator circuit.

DETAILED DESCRIPTION

In FIG. 1, a traffic controller is indicated at 10, as having output at 11, connected at 12–16 with load switches 17–20. Such switches have outputs at 21–24 connected at 25–29 with flash transfer relay means 30, which is in turn connected at 31–36 with traffic control light units 37–40. The latter are normally located at different corners of a roadway intersection. When a system malfunction occurs, red lights in units 37–40 are placed in a flashing mode. This is accomplished by the high current capacity relay means 30, which receives a flash initiating signal from a conflict monitor 41, via connection 42. The relay removes power transmission from the load switches to the lights (the four load switches normally connected via the relay to the respective four lights), and connects power transmission from the flasher circuit 43 to all light units.

The conflict monitor 41 is shown as operatively connected with the load switches 17–20, as via bus 44, Load Management System (LMS) analog board 45, bus 56 and connections 47–50, whereby the monitor 41 measures the presence or absence of predetermined or selected AC field wire voltages at the outputs of the switches 17–20, for example appropriate level AC voltage level supply to the light units from the load switches. Also, the conflict monitor 41 monitors the DC voltage from the controller that is used to turn each load switch output ON. If the DC voltage from the controller is not selected, but the output from the load switch is ON or vice versa, the conflict monitor determines that a malfunction has occurred and initiates corrective action.

Such measurements by the conflict monitor may effectively be made by comparing the AC voltage level with a selected level, as in a comparator; and by comparing the DC voltage level with a selected (24 volt) level, as in a comparator. Such measurements are made by the conflict monitor while measuring the current actually drawn by the signal lamp loads at the light units as via bus 44 connected with output leads 25–28. Bus 44 provides DC voltage status of the load switches 17–20 to the monitor 41; whereas bus 52 provides AC voltage information to the monitor.

LMS circuit 44 is not only connected at 47–50 and via board 45 with the load switches, but also with the flasher circuit 43 via connector 55. The LMS and conflict monitor 41 respond to a malfunction, such as dropping of the AC output voltage from a load switch below a threshold, to cause the relay means 30 to decouple from the load switches, and couple to the flasher unit, at a non-load condition during the AC cycle. This is extremely beneficial, as the electro-mechanical flash transfer relays used at 30 for load switching normally are required to transfer relatively high electrical currents; and if switching is done with random timing during the AC cycle, arcing can likely occur, causing damage to the load switches 17–20, to the flasher circuit 33, and other devices. Note also that the monitor 41 enables malfunctioning corrective action to be initiated without removing control by controller 10 of operating of the traffic signal lights 37–40. This allows the traffic intersection to be operated (by the lights) in a highly efficient manner, to enable increased vehicular traffic flow and correspondingly reduced vehicle fuel consumption.

Figure 2:
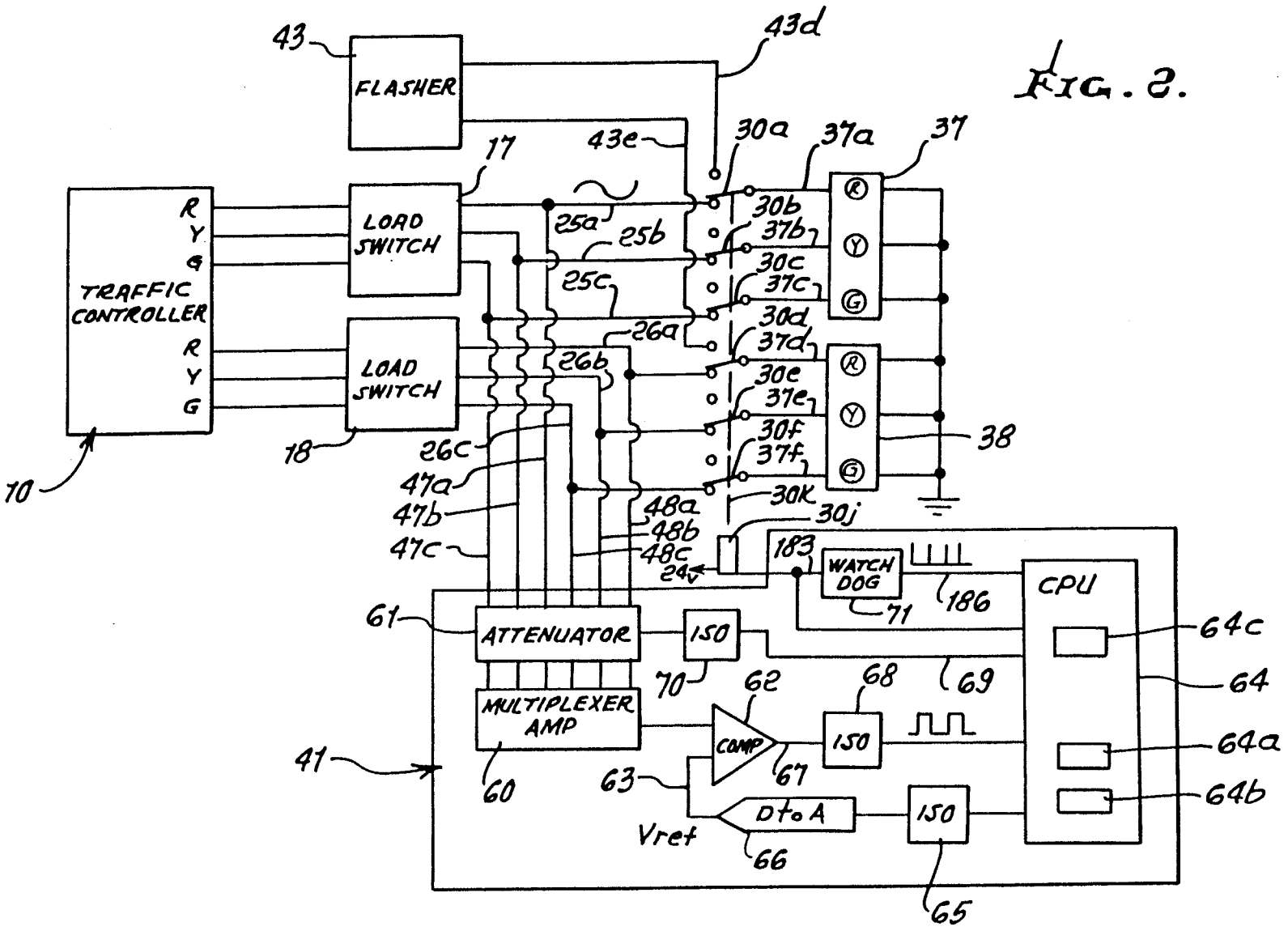
FIG. 2 is a block diagram showing AC field wire voltage monitoring.

FIG. 2 shows in further detail the manner in which the conflict monitor measures the output voltages from the load switches and compares these with a reference. Load switch 17 has connections 25*a*, 25*b* and 25*c* with relay switches 30*a*, 30*b* and 30*c*; and the latter are connected at 33*a*, 33*b* and 33*c* with the red, yellow and green lights of light units 37, as shown. Likewise, load switch 18 has connections 26*a*, 26*b* and 26*c* with relay switches 30*d*, 30*e* and 30*f*; and the latter are connected at 38*a*, 38*b* and 38*c* with the red, yellow and green lights of light unit 38. Typically, one relay 30 is used (see one armature 30*k* solenoid controlled at 30*j*. In one position, it allows connections from 25*a*, 25*b*, and 25*c* to light inputs at 37*a*, 37*b*, and 37*c*, as shown; in another position of 30*k*, it connects only red light inputs 37*a*, 38*a*, etc., with the flasher 43, as via leads 43*d* and 43*e*.

Outputs from lines 25*a*–25*c* are connected via lines 47*a*, 47*b* and 47*c* with a multiplexer amplifier 60, via attenuator 61, in monitor 41 (which may be considered to include LMS board 45); and outputs from lines 26*a*–26*c* are connected via lines 48*a*, 48*b* and 48*c* with 60 and 61. The multiplexer applies the voltages on 47*a*–47*c* and 48*a*–48*c*, one at a time to the comparator 62, where they are compared with a reference voltage applied at 63 to the comparator. That reference voltage is supplied and controlled via CPU 64, as via isolator 65 and digital to analog converter 66. The comparator output at 67 is fed via isolator 68 to the CPU, for processing to determine whether it exceeds (for any of the AC inputs at 47*a*–47*c* and 48*a*–48*c*) a selected threshold level, thereby indicating a malfunction. Attenuator 61 is controlled by the CPU via line 69 and isolator 70 (buffer). A "watch dog" signal is transmitted at 71 by the CPU to monitor proper operation of the CPU.

The conflict monitor CPU may be programmed to monitor for occurrence of malfunctions and to react to them as a fault as has traditionally been the practice in the industry where the intersection is removed from actuated control by the controller 10 and put into flashed control by the flasher 43, or to react to malfunctions as a message where the occurrence of the malfunction is recorded, stored, and, if desired, transmitted to other equipment without removing control of traffic from the traffic controller 10. The benefits of this are increased traffic flow, reduced congestion, reduced fuel consumption, and reduced vehicle emissions (pollution). Separate memory records may be used for the purpose of storing faults and messages. See record means 64*a*.

The LMS also logs into a memory record the occurrence of user-inputted and traffic control system-initiated changes in the operation of the load management system. This information is recorded and stored in a memory record, as at 64*b*, which may be separate from the fault and message memory records. Information logged relates to times and dates, and nature of changes in the monitoring operation, and to the information stored in other memory records, such as fault memory and message memory.

Referring now to FIGS. 3 and 5, the means to monitor the DC circuit levels at the inputs to the load switches will now be described. Each load switch has three inputs, as well as three outputs, previously referred to, as at 25*a*–25*c* and 26*a*–26*c*. FIGS. 3 and 5 show load switch 17 DC inputs at 80*a*–80*c*, and analog channel 80*d* connected to 80*a*–80*c*, and also connected to the LMS, including analog board 45 and multiplexer 83. The latter delivers those three analog circuit levels, serially, via connector 84 to an A to D converter 85 in monitor 41. FIG. 6 illustrates such a board 45 in greater detail. (Parallel delivery of circuit levels could be employed.)

Refer now to FIGS. 3*a* and 5 showing the three DC input levels A, B and C fed to the converter 85 (in 41) via the three resistors 86, 87 and 88, to summing junction 89, the resistors having different values. See FIG. 3*a* for representative values. Three diodes 90–92 are in series with the respective resistors to prevent DC inputs from feeding energy into the board 45 and monitor 41. Inside the monitor 41 the analog DC signal obtained is tied at 93 to a stable reference voltage 94, through a resistor 95. The latter, plus the three resistors 86–88 in the load switch 17, form a voltage divider when a DC input from the load switch is selected by the controller. A filter comparator is shown at 96. By converting the analog DC status signal to a digital signal, the signal monitoring unit can determine which resistor (86, or 87, or 88) in the load switch is included in the divider network; and this in turn allows determination by the monitor of which DC input (80*a*, 80*b* or 80*c*) is ON, at a particular load switch. See also the detailed circuitry in FIG. 9.

As described, the load switch has three associated signals: DC input A, DC input B, and DC input C which represent three inputs from the controller unit to the corresponding DC inputs A, B and C. To turn on an output, the corresponding input requires a DC low voltage. When nothing is selected or when there is no connection between the conflict monitor and the load switch, the pull-up resistor, R4, at 95, sets the A to D value to 5 volts DC (assuming that voltage reference is 5 volts). When an input is selected, the corresponding resistor inside the load switch and resistor 95 form a divider network. This network will give different A to D values depending on which resistor is included in the network. The table below shows the different A to D values based on the different input selected. Voltage reference is assumed to be 5 volts DC.

| INPUT SELECTED | RESISTORS IN NETWORK | A TO D VALUE |
|---|---|---|
| None | R4 | 5.00 volts |
| A | R1, R4 | 1.56 volts |
| B | R2, R4 | 2.38 volts |
| C | R3, R4 | 3.23 volts |
| A, B | R1, R2, R4 | 1.16 volts |
| A, C | R1, R3, R4 | 1.33 volts |
| B, C | R2, R3, R4 | 1.88 volts |
| A, B, C | R1, R2, R3, R4 | 1.03 volts |

Referring to FIG. 7, it shows in more detail the functional blocks of the conflict monitor for measuring AC signal voltages supplied to the signal lights or lamps, and also as referred to above. It incorporates for each light channel (red, yellow and green) use of a reference voltage, as at 63 (for example) that can be changed by the DAC 66, under control of the microprocessor CPU 64.

The invention enables changing of input circuitry to measure traffic signal lamp voltages using different microprocessor set thresholds at different times. In doing this, several benefits are achieved:

a) By setting the reference to 0 volts, the input circuitry becomes a zero crossover detector which can be used to verify that the measured traffic signal voltage is in phase with the AC line voltage and is not shorted to another phase voltage (for instance street lights).

b) Setting the reference to a negative voltage allows the measurement of only the negative one half cycle. This then allows the microprocessor to determine if the negative half cycle of traffic signal voltage is present and of sufficient amplitude to drive the traffic signal lamp.

c) Setting the reference to a positive voltage allows for the measurement of only the positive half cycle. This then allows the microprocessor to determine if the positive half cycle of traffic signal voltage is present and of sufficient amplitude to drive the lamp.

d) The determination or knowledge of the presence of a half wave signal will allow the microprocessor to set different references for half wave than for full wave traffic signal voltages. This is important because conservation of power is often achieved by providing half wave rectified voltages to traffic signals.

e) This technique is also used to measure the load resistance during the OFF time, thus giving the microprocessor a method of testing for the presence of, and for the amount of, the load. This provides a method for measuring current which does not require the use of additional current sensor loops.

The above additional information provided to the microprocessor can be used to record when a malfunction occurs and to report to a central office without having to put the intersection into flash. This makes it possible for increased traffic flow, reduced fuel consumption and reduced down time.

In FIGS. 12 (*a*)–(*d*), the microprocessor first sets up the reference to 0 volts DC and waits until a change of state occurs from 0 to 1 at the output of the comparator 137. See 12(*b*). At the time the state changes, the input is at 0° in FIG. 12(*a*). Then the microprocessor sets up the D to A for a reference into the comparator equal to the required threshold of the positive half cycle. At this time, the output of the comparator will change from 1 to 0. The microprocessor continues to monitor the output for a state change from 0 to 1 within a time period that does not exceed ½ the cycle time. If the states does change from 0 to 1, the positive threshold was reached. The microprocessor then sets up the reference to 0 volts DC and waits until it sees a change of state from 1 to 0 at the output of the comparator. At the time the state changes, the input is at 180°. Then, the microprocessor sets up the D to A for a reference into the comparator equal to the required threshold of the negative half cycle. At this time, the output of the comparator will change from 0 to 1. The microprocessor continues to monitor the output of the comparator for a state change from 1 to 0 within a time period that does not exceed ½ the cycle time. If the state does b change from 1 to 0, the negative threshold was reached. If it does not occur in less than ½ cycle time, the threshold was not reached. At this time, the microprocessor will set the D to A to 0 volts DC and repeat this process all over again looking for the 0° point.

Should the positive or negative thresholds not be reached, the input is not present. There will, however, always be a zero crossover due to leakage current of the surge protection circuitry in the load switch. During the time that there is no input present to a load switch circuit, the load for the corresponding output can be measured by switching the input attenuator OFF with an analog switch. This gives the effect of changing the range.

In FIG. 13(*a*) to 13(*d*), the microprocessor sets up the reference to 0 volts DC and waits until it sees a change of state from 0 to 1 at the output of the comparator 141. At the time the state changes, the input is at 0°. Following this state change of 0 to 1, the microprocessor then steps up the D to A for a reference into the comparator and looks for the next state change from 1 to 0. At the time the state change from 1 to 0 occurs, the reference is greater than the input. Then, the microprocessor continues to monitor the output of the comparator until the state changes from 0 to 1. If the time has not passed ¼ cycle time, the microprocessor steps up the D to A for a reference into the comparator 141, and looks for a state change from 0 to 1 just as before until ¼ cycle time has passed. At this time, the peak voltage is reached and the voltage measured is proportional to the load resistance. This measurement can be made every time that the load switch is turned OFF and can be compared to the previous measurement, thereby permitting detection of load changes, such as can be caused due to burning out of signal lamps.

This technique is especially beneficial because it can automatically measure out-of-phase AC voltages. By gradually changing the reference voltage and looking for the state changes at the output of the comparator, the conflict monitor can determine where the peak of an input is, and in turn, determines the out-of-phase angle of the input from the AC line reference.

Referring to FIG. 8, it shows hold-off circuitry associated with each load switch, also seen in FIG. 5, as referred to above.

As shown, at the time that a conflict is sensed and just before the flash transfer relay is dropped, a signal is sent at 95 to the load switches 17–20 and flasher 43. This signal will momentarily turn them OFF (hold off), as via circuits 110, during the time that the flash transfer relay is dropped. This will prevent the flash transfer relay from burning its contacts and possibly sticking, ensuring safe operation of the intersection and ensuring the reliable operation of the flash transfer relay.

Note connector at 95 (in the analog board) between monitor transistor 96 and current source means 97–99 in the load switch circuits 17, 18, and 19, for this purpose.

The flasher circuitry 43 seen in FIGS. 1 and 8 is shown in detail in FIG. 4.

In FIG. 4, the driver logic supply 103, alternately selects either the triac 104 or 105 to generate an output 104*a* or 105*a*. These outputs then feed through the inputs of the opto-isolators 106 and 107. Two resistors of different values 110 and 111 are connected to the respective outputs from the opto-isolators 106 and 107, respectively. Resistors 108 and 109 provide pull-up to Vcc. When the output of triac 104 is turned ON, the corresponding opto-isolator 106 is also turned ON. The resistors 109, 111, and 110 form a network divider with analog channel out 112 being measured through an A to D converter 116 with the pull-down resistor 113 and a filter capacitor 114. When triac 105 is turned ON, opto-isolator 107 is turned ON. Resistors 108, 110, and 111 form a different network divider and give a different value of analog channel out 112. By monitoring the analog channel out 112, the conflict monitor 41 can detect that the flasher 43 is operating by observing the analog channel out 112 switching from one level of voltage to another.

In FIG. 2, the relay armature 30*k* is connected to all the switch arms, to simultaneously switch their positions in response to energization of solenoid 30*j*. That solenoid is operated, via line 182, by a driver associated with the CPU of monitor 41, when a malfunction event occurs, thereby to cause disconnection of the load switches from the traffic lights (as at 37 and 38), and to connect the flasher circuit 43 with the traffic signal red lights, as is clear from FIG. 2. The same operation of the relay 30, to produce red light flashing, occurs in the event the microprocessor CPU itself malfunctions; for example, interruption of CPU clock signals delivered at 186 to the watch dog circuit 71 causing the latter to operate the solenoid 30*j* via line 183, to effect red light flashing in the manner referred to.

In FIG. 4, the A and B outputs are fed to the relay 30, as via each of lines 43*d* and 43*e*, seen in FIG. 2. The opto-isolator circuit 190 in FIG. 4 is also referred to in connection with the description of FIG. 8.

Each load switch and flasher contains a 0° phase angle driver. Simply stated, by using the load switch and flasher to switch the power, damage due to current in-rush surges is brought to a minimum. This is accomplished by sending a positive signal to all of the load switches and flashers (FIGS. 4, 5 and 8) through the analog board before the flash transfer relay is de-energized. In the load switch (FIG. 5), this signal is capacitively coupled to a current regulator and for a short, controlled period of time (one to five AC line cycles) the current regulator is changed from a 20 ma current regulator to a 0 ma current regulator. This current is not adequate to drive the opto-isolator, used within the load switch to supply power to the signal lamps, and, in turn, for that period of time will shut down of all the load switches. The flasher (FIG. 4) at the same time receives the same hold-off signal. It is driven through an opto-isolator where, on the AC line side, it is capacitively coupled to a blinking input on internal logic; or it may instead be capacitively coupled to a transistor that momentarily shorts the flasher DC supply voltage that runs the internal logic. Either circuit will work, with the end result being that the flash transfer relay and the load switches and flasher are all saved from excessive current in-rush by ensuring that all switching is done at the zero crossover time. This aspect of the invention has applicability in fields other than traffic control, where solid state relays are used in conjunction with electromechanical relays or magnetic contactors.

The invention also enables circuit measurement in a simple, effective manner through use of a saturable core reactor, or reactors, as shown at 100 in FIGS. 5, 10, and 11(*d*).

The illustrated reactor 100 is a toroid that is driven into saturation by the current to be measured, i.e., the current being supplied to the load. See line 25*a*. This approach is different and unique from traditional current transformers in that current transformers are not driven into saturation. The counter EMF generated by the saturable reactor of this invention is then rectified at 110*a* and integrated at 101 to represent the current for a resistive load and supplied at 102 as an analog circuit to the LMS. These integrated voltages are not linear with respect to the current and more sensitive for small loads than for large loads. The present invention does not require that a linear measurement be made and provides increased sensitivity at lower currents. This invention can be employed to detect a partial or a complete loss in load, such as the loss of a traffic signal lamp from a parallel string of lamps. A lamp out detection may be accomplished by detecting a sudden drop in the current supplied to the load.

A corresponding reactor 100' is used in the flasher for measurement of current supplied to loading during flasher operation. See 101' and 102' as in FIG. 4.

Considering the above, note that $$\text{Volt source} = \text{volt load} + \text{volt inductor}$$

$$\text{Voltage total} = (R \times I) = (L \times di/dt)$$

with the voltage across the inductor equal to $$V = L \times di/dt,$$

where
V=voltage,
L=inductance,
di=change in current
dt=change in time

Ampere's Law $$I = 0.795 \times H \times 1 \times I/N,$$

where
I=peak magnetizing current in Amperes
0.795=1/(pi×0.4),
H=magnetizing force in Oersteds,
l=mean magnetic path length in cm,
N=number of turns in primary.

Simply stated from these equations, di is a constant derived from the fact that H in Ampere's Law reaches a maximum value at the saturation of the magnetic core. Therefore, the current I reaches a maximum value as well. This I maximum defines di in the previous equation. Consider the case of a small load where the applied voltage is a sine wave (FIG. 2). Some amount of time, dt, is required in the case of a larger load. As dt increases, voltage decreases. As dt decreases, voltage will increase. This voltage is stepped up on the secondary winding of the toroid and is rectified and integrated in order to be read as an analog voltage representing the current drawn by the load.

There are several advantages:

1. Electrical isolation from the load is maintained.
2. The voltage measurement is non-linear, making it more sensitive at lower currents. This has the effect of automatically changing the range of the current measurement.
3. The current sensor does not have a voltage drop after the magnetic core is saturated, resulting in less power loss from the load to the magnetic core than with other techniques.
4. Surge protection is provided by this circuit because the maximum energy that can be coupled to the secondary is the energy that is stored in the core. The nature of this invention is that small amounts of energy are stored. This assumes good isolation from the load.
5. Reduced size and cost from other current measurement techniques is achieved due to the fact that a small core is required in order to saturate the core.

This approach works well in applications requiring measurement of changes in resistive load current, such as for detecting tungsten lamp outages in traffic signal displays. Another advantage of this invention is that manual calibration is not required. A microprocessor can be used without the need to know what the actual value of the current is; it is only necessary to know if the current has changed. This fact is extremely useful in automatic measurement and reporting of load current changes such as light bulb burn-out occurrences.

Faraday's Law:

$$B = (E \times 100{,}000{,}000)/(4.4 \times A \times N \times f),$$

where
B=maximum flux density in gauss,
E=voltage across core in volts,
A=core cross sectional area in cm squared,
N=number of turns on the primary,
f=frequency in hertz.

$$L = (0.4 \times pi \times u \times N \times N \times A)/(1 \times 10{,}000{,}000),$$

where
L=inductance,
u=core permeability (u=B/H),
B=maximum flux density in gauss,
H=magnetizing force in Oersteds,
N=number of turns in primary,
A=core cross sectional area in cm squared,
l=means magnetic path length in cm.

The constants A, l and u are fixed in the selection of the core to be used.

Faraday's Law is used in determining a suitable core, and it is desirable in the application of detecting traffic signal lamp losses to use a tape wound core as opposed to other types for the following reasons:

1. The tape wound core does not have a distributive gap. A distributive gap prevents saturation of the core.
2. Higher gauss levels (magnetic flux density) can be achieved. This results in much more accurate measurement because the signal strength is many times higher than with other types of toroid cores.
3. This application requires load current measurements on an alternating current line. This is a low frequency application (50–60$H_z$) making it ideal for the tape-wound core which works well at lower frequencies than other types of toroid core. Not nearly as many urns around the tape-wound core are required to yield the same measured voltage, E, as would be required using cores, other materials and construction.

SUMMARY

The LMS herein is used in traffic controller assemblies to monitor and ensure the safety of intersection operation. The LMS incorporates the signal monitor unit, which measures load currents to know when signal lamps fail; monitors and compares controller 24 volt DC driver signals with load switch outputs to identify precisely which equipment fails; continuously monitors flasher unit outputs before "flash" operation of the intersection is required to verify that the flasher unit will perform when the lamp loads are transferred to it; and eliminates electrical voltage and current transients from being generated by flash transfer relays to prevent their destruction as well as that of other cabinet electronics.

Special load sensing switches measure load current permitting detection of the loss of solid state and fiber-optic signals as well as field wire shorts. Load current measurements are sent to the monitor using a simple harness and no cabinet rewiring or modification is necessary. With the harnessing, the signal monitor unit is also provided with controller 24 volt DC driver signal status, which is compared with load switch outputs to confirm proper operation of traffic signals. This permits identification of equipment which malfunctions saving valuable maintenance personnel and service equipment time. The simple harnessing used also connects the SMU (i.e., monitor) with the flasher units so that their outputs may be continuously monitored for proper operation before they need to control the intersection. Failure of flasher units as well as all other information stored in the SMU can be communicated to another location via modem or RS232 connections or retained within internal memory for retrieval when a field service person arrives. A convenient "MESSAGE" indicator 64c calls attention to changes in recorded information and to needed maintenance.

When flash transfer relays are required to transfer signal lamp loads to flasher units, generation of high voltage and high current transients caused by arcing of contacts is avoided. This prevents damage to electronic equipment within the controller assembly and to flash transfer relay contacts such that their replacement is virtually eliminated.

Sensing of load currents and 24 volt DC driver signals can be performed outside of the load switches and flashers, such that the simple harnessing described to connect load switches to the monitor is eliminated. The sensing of load currents and 24 volt DC signals may be performed within another device, such as the traffic controller, an interface unit, or at the field wire termination panel itself, and processed and compared with AC voltage measurements within the conflict monitor or another device, such as the traffic controller or a remotely located computer.

We claim:

1. In a traffic control system for use at a roadway intersection, the system including traffic control lights, a light flasher means for effecting light flashing, relay means for electrical coupling, and a plurality of load switches electrically coupled with said lights via said relay means to which said light flasher means is connected, said load switches having inputs, and a controller connected with said load switches for controlling normal operation of said lights and flashing of one or more of said lights by said light flasher means in the event of a system malfunction, the combination comprising a) a microprocessor operatively connected with the said load switches, said light flasher means, and said relay means to monitor the system for detecting a malfunction event, for recording the detected malfunction event, and for transmitting the detected malfunction event to another location, b) and verification means at said other location for i) receiving said transmitted malfunction detection, ii) verifying said event, and iii) initiating malfunction corrective action, c) whereby said corrective action in said system may be initiated without removing control by the controller of said operation of the traffic control lights at said intersection.

2. The combination of claim 1 wherein said load switches have output sides and said microprocessor is coupled to the output sides of said load switches to receive AC signals from said load switches which are compared with selected input signal levels to determine malfunction events, there being means for providing said selected input signal levels.

3. The combination of claim 2 including a comparator coupled to said load switches and having inputs from said load switches, and including a reference voltage source, said comparator receiving input from said reference voltage source.

4. The combination of claim 1 including flash transfer relay means coupled to said light flasher means, and wherein said microprocessor includes circuit means for transferring traffic signal lamp loads from the load switches to the light flasher means under substantially no-load conditions whereby arcing of the flash transfer relay means is suppressed.

5. The combination of claim 1 wherein said controller supplies control DC signals having signal levels, the load switches have input sides coupled to the controller to receive said control DC signals, and the microprocessor includes means coupled to the input sides of the load switches to measure said DC signal levels.

6. The combination of claim 2 including saturable core reactor means coupled to said load switches.

7. The combination of claim 6 including signal integration means coupled to the output side of said reactor means for representing the current for a resistive load.

8. The combination of claim 5 wherein said load switches have output sides and said microprocessor is coupled to the output sides of said load switches to provide AC signals which are compared with selected input signal levels to determine malfunction events and including hold-off circuitry means coupled to said load switches and said light flasher means to hold of switching of loads to the lights via the light flasher means to a selected low-level time during an AC cycle associated with an AC signal.

9. The combination of claim 2 wherein said microprocessor is coupled to an output side of said flasher means to enable determination of malfunction of said flasher means.

10. The combination of claim 1 wherein the load switches have output sides and said microprocessor has coupling to the output sides of the load switches to provide AC load current measurements enabling determination of malfunction events.

11. The combination of claim 10 wherein said coupling includes a saturable core reactor.

12. The method of operating the system of claim 1 including i) causing the microprocessor to establish different signal thresholds, including $x_1$) a 0 volt reference, whereby a 0 level signal crossover detector is provided to verify that the measured traffic signal lamp voltage is in phase with the AC line voltage and is not shorted to another phase voltage, $x_2$) a negative voltage reference, for measurement of only the negative half cycle of traffic signal voltage, and for determination as to whether its amplitude is sufficient to drive a traffic signal lamp, $x_3$) a positive voltage reference for measurement of only the positive half cycle of traffic signal voltage whereby load current can be measured without use of current sensor loops.

13. In a traffic control system for use at a road intersection, the system including traffic control lights, a light flasher means for effecting light flashing, relay means for electrical coupling, and a plurality of load switches having output sides electrically coupled with the lights via said relay means to which said light flasher means is also connected, and a controller connected with said load switches for controlling normal operation of said lights and flashing of one or more of said lights by said light flasher means in the event of a system malfunction, the combination comprising a) a signal monitor means coupled to said light flasher means via said relay means, and also coupled to said load switches, whereby the signal monitor monitors voltage at said output sides of the load switches, b) each load switch having three DC inputs, three corresponding outputs, one output being turned ON in response to application of a DC ground to the corresponding DC input, c) a voltage summing circuit coupled to the input of each load switch, said circuit including three interconnected resistors respectively in series with said DC inputs, and said circuit coupled to said signal monitor means, d) the voltage summing circuit including three diodes respectively connected in series with the three resistors to prevent the DC inputs from feeding energy to the signal monitor means when said inputs are in off-state, e) the signal monitor means including an additional resistor coupled to a stable reference voltage, f) said additional resistor and the three resistors in said voltage summing circuit forming a voltage divider when a DC output from the load switch is selected by the controller, to allow determination of which DC input is ON, at a particular load switch.

14. The combination of claim 13 including an A to D converter in said monitor, and having its output coupled to said voltage divider between said additional resistor and said three resistors, said three resistors having different resistance values and connected in parallel with said additional resistor.

15. The combination of claim 13 wherein AC field wire voltages are supplied to power said traffic control lights and 24 volt DC input signals are supplied from a power supply to the load switches, and wherein said microprocessor includes conflict monitor means for measuring said AC field wire voltages and said i24 volt DC input signals and for comparing said AC voltages and said DC inputs to determine malfunction.

16. The combination of claim 15 wherein the conflict monitor includes circuit means for transferring traffic signal lamp loads from the load switches to the flasher means under substantially no-load conditions whereby arcing at the relay means is suppressed.

17. The combination of claim 15 wherein said monitor means includes internally or externally located load sensing switches, or current sensing means, to measure load currents supplied as a result of said 24 volt DC inputs.

18. In a traffic control system for use at a road intersection, the system including traffic control lights, a light flasher means for controlling light flashing, relay means for electrical coupling, and a plurality of load switches electrically coupled with the lights via said relay means to which said light flasher means is also connected, and a controller connected with said load switches for controlling normal operation of said lights and flashing of one or more of said lights by said light flasher means in the event of a system malfunction, the combination comprising a) a signal monitor means, b) each load switch having three DC inputs, three corresponding outputs, one output being turned ON in response to application of a DC ground to the corresponding DC input, there being means to allow determination of which DC input is ON, at a particular load switch, c) there being power supply means connected to the load switches, and AC field wire voltages being supplied to power said traffic control lights and 24 volt DC input signals are supplied from said power supply means to the load switches, and wherein said microprocessor includes conflict monitor means for measuring said AC field wire voltages and said 24 volt DC input signals and for comparing said AC voltages and said DC inputs to determine malfunction.

19. The combination of claim 18 wherein the conflict monitor includes circuit means for transferring traffic signal lamp loads from the load switches to the light flasher means under substantially no-load conditions whereby arcing at the relay means is suppressed.

* * * * *